United States Patent [19]

Alaimo

[11] Patent Number: 4,747,420

[45] Date of Patent: May 31, 1988

[54] POCKET COLOR COMB

[76] Inventor: Vincent J. Alaimo, 72 Bangor St., Staten Island, N.Y. 10314

[21] Appl. No.: 36,364

[22] Filed: Apr. 8, 1987

[51] Int. Cl.[4] ..... A45D 24/22

[52] U.S. Cl. ..... 132/112

[58] Field of Search ..... 132/116, 108, 112

[56] References Cited

U.S. PATENT DOCUMENTS 1,004,371 9/1911 Cohen ..... 132/108 X
2,299,296 10/1942 Battle ..... 132/108
2,461,789 2/1949 Usai ..... 132/116 X
3,520,311 7/1970 Iesersek et al. ..... 132/116 X

*Primary Examiner*—Gregory E. McNeill
*Attorney, Agent, or Firm*—Richard L. Miller

[57] ABSTRACT

This comb is designed to apply hair dye or perfume to one's hair, and the dye or perfume is saturated into a common pipe cleaner that is received in a cylinder rotatively received in the main body of the comb. The dye or perfume is dispensed between the teeth of the comb and the cylinder containing the pipe cleaner, and is rotated to shut off any further flow of dye or perfume.

5 Claims, 1 Drawing Sheet

POCKET COLOR COMB

BACKGROUND OF THE INVENTION

The instant invention relates generally to grooming devices and more particularly, to a pocket color comb.

Numerous grooming devices have been provided in the prior art that are adapted to be used on one's hair. While these units may be suitable for the particular purpose to which they address, they would not be as suitable for the purpose of the present invention as hereafter described.

SUMMARY OF THE INVENTION

A primary object of the present invention is to provide a pocket color comb that will overcome the shortcomings of the prior art devices.

Another object is to provide a pocket color comb, which will be so designed, as to apply hair coloring or perfume to the one's hair.

An additional object is to provide a pocket color comb, which will employ a pipe cleaner for absorbing a hair color or perfume.

A further object is to provide a pocket color comb that is simple and easy to use.

A still further object is to provide a pocket color comb that is econimical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 2:
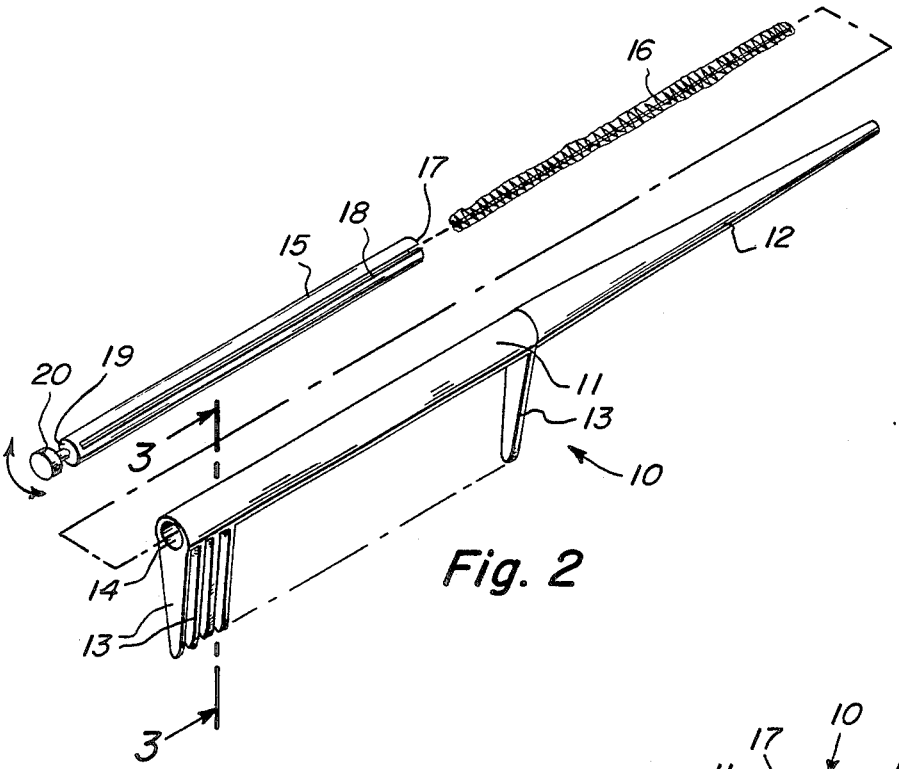
FIG. 2 is an exploded perspective view of the invention per se.
Figure 1:
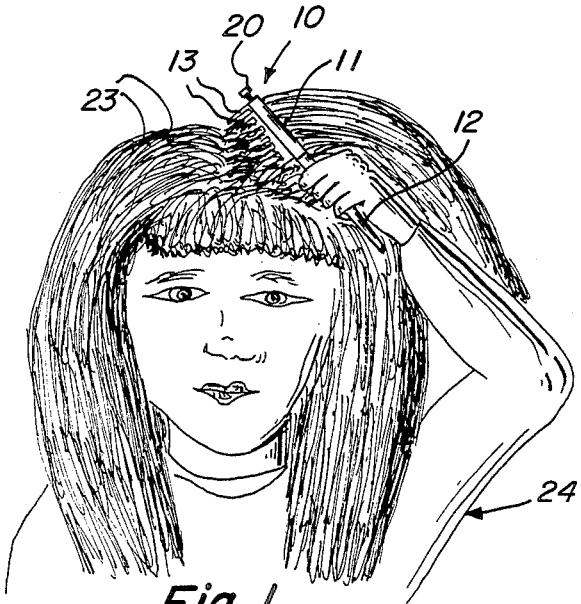
FIG. 1 is a perspective view of the invention, shown in use.
Figure 3:
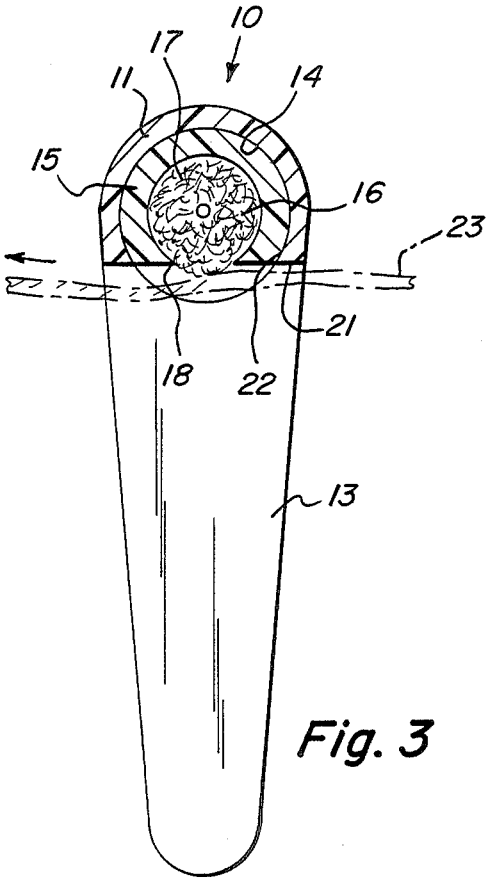
FIG. 3 is an enlarged cross-sectional view, taken along the line 2—2 of FIG. 1.

Turning now descriptively to the drawings, in which like reference characters denote like elements throughout the several views, FIG. 1 illustrates a comb 10 which includes a main body 11 of cylindrical configuration and having a handle 12 integrally attached thereto. A plurality of spared teeth 13 are also integrally attached to main body 11, and a longitudinal bore 14 through main body 11, removably receives a cylinder 15 that removably receives a disposable pipe cleaner 16 which may be coated with a suitable hair dye or perfume to be applied to one's hair. Pipe cleaner 16 is received in the bore 17 of cylinder 15 and a longitudinal cut-out opening 18 intersects with 17 and extends from an open end of cylinder 15, to the end wall 19 of cylinder 15.

A stemmed knob 20 is fixedly secured to end wall 19 and provides a means of rotating cylinder 15 to dispense hair dye or perfume from the saturated pipe cleaner 16 received in bore 17. In the bottom surface 21 of main body 11, an opening 22 is provided and enables the dye or perfume from pipe cleaner 16 to be dispensed onto strands of hair 23 of the person 24 using comb 10.

It shall be noted, that the outer peripheral portion of pipe cleaner 16, extends below bottom surface 21, so as to efficiently engage with hair 23 to deposit the dye or perfume thereon.

In use, cylinder 15 is furst removed from the bore 14 of main body 11. After the above, a clean pipe cleaner is saturated, with hair dye or perfume and inserted within bore 17 of cylinder 15. Cylinder 15 in again inserted into bore 14 of main body 11 and rotated by knob 20 to align opening 18 with opening 22. The comb 10 is then used in normal fashion to comb hair 23. As hair 23 is being combed, the dye or perfume of pipe cleaner 16, is dispensed onto the hair 23. When finished, the knob 20 is rotated to the shut-off position which is 180° of rotation, which dis-aligns opening 18 with opening 22.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A color pocket comb, comprising, a main body, a cylinder slidably received in said main body for rotation within said main body thereby controlling a flow of dye/perfume onto strands of hair, an elongated slot in said cylinder, and a pipe cleaner received in said cylinder for retaining said dye to be dispensed through said slot and onto said strands of hair.

2. A color pocket comb as set forth in claim 1, wherein said cylinder is removably received in a longitudinal bore in said main body and a knob is fixedly secured to an end wall of said cylinder for rotating said cylinder to a shut off position, and said main body includes a longitudinal opening in a bottom surface, for providing for said flow of dye/perfume into openings between teeth of said main body.

3. A color pocket comb as set forth in claim 2, wherein said pipe cleaner is saturated with said dye/-perfume and is removably received in said cylinder.

4. A color pocket comb as set forth in claim 3, wherein an outer periphery of said pipe cleaner is exposed between said teeth and deposits said dye/perfume onto strands of hair received between said teeth.

5. A color pocket comb as set forth in claim 1, wherein said pipe cleaner extends longitudinally through said slot.

* * * * *